US011352156B2

(12) United States Patent
Bradley et al.

(10) Patent No.: US 11,352,156 B2
(45) Date of Patent: Jun. 7, 2022

(54) PACKAGING MACHINES AND IMPROVEMENTS THERETO

(71) Applicant: Keymac Packaging Systems Limited, Bristol (GB)

(72) Inventors: Albert Bradley, Bristol (GB); Michael Bradley, Bristol (GB)

(73) Assignee: KEYMAC PACKAGING SYSTEMS LIMITED, Bristol (GB)

( * ) Notice: Subject to any disclaimer, the term of this patent is extended or adjusted under 35 U.S.C. 154(b) by 0 days.

(21) Appl. No.: 16/009,767

(22) Filed: Jun. 15, 2018

(65) Prior Publication Data

US 2018/0362199 A1 Dec. 20, 2018

(51) Int. Cl.

| | |
|---|---|
| ***B65B 35/50*** | (2006.01) |
| ***B65B 35/40*** | (2006.01) |
| ***B65B 35/54*** | (2006.01) |
| ***B65B 5/02*** | (2006.01) |
| ***B65B 5/06*** | (2006.01) |
| ***B65D 71/24*** | (2006.01) |
| ***B65B 9/13*** | (2006.01) |

(52) U.S. Cl.

CPC ..... *B65B 35/50* (2013.01); *B65B 5/024* (2013.01); *B65B 5/06* (2013.01); *B65B 9/13* (2013.01); *B65B 35/40* (2013.01); *B65B 35/54* (2013.01); *B65D 71/243* (2013.01); *B65D 2571/0037* (2013.01); *B65D 2571/0066* (2013.01); *B65D 2571/00141* (2013.01); *B65D 2571/00716* (2013.01); *B65D 2571/00728* (2013.01); *B65D 2571/00932* (2013.01)

(58) Field of Classification Search

None

See application file for complete search history.

(56) References Cited

U.S. PATENT DOCUMENTS

| | | | | |
|---|---|---|---|---|
| 3,466,835 | A * | 9/1969 | Temple | B65G 1/04 53/448 |
| 3,473,289 | A * | 10/1969 | Vadas | B65B 5/06 53/497 |
| 3,941,236 | A | 3/1976 | Hagedorn | |
| 4,645,061 | A | 2/1987 | Welch | |
| 5,456,058 | A * | 10/1995 | Ziegler | B65B 5/106 53/447 |
| 5,727,365 | A * | 3/1998 | Lashyro | B65B 5/024 53/157 |
| 6,711,878 | B1 | 3/2004 | Paselsky et al. | |
| 2008/0168749 | A1* | 7/2008 | Regelski | B65B 35/50 53/447 |
| 2016/0362220 | A1* | 12/2016 | Kearns | B65D 5/48014 |

FOREIGN PATENT DOCUMENTS

| | | | |
|---|---|---|---|
| GB | 1167325 A * | 10/1969 | B65B 35/54 |
| GB | 1223172 | 2/1971 | |
| WO | 9420368 | 9/1994 | |
| WO | 9601764 | 1/1996 | |

* cited by examiner

*Primary Examiner* — Hemant Desai
*Assistant Examiner* — Tanzim Imam
(74) *Attorney, Agent, or Firm* — C. Brandon Browning; Maynard, Cooper & Gale, PC

(57) ABSTRACT

An automatic packaging machine is provided and comprises a plurality of in-feed conveyors for separately conveying contents. The conveyors are at different heights. The machine includes means for placing the contents into a packaging article, or placing the packaging article around the contents, with the contents in a vertically stacked configuration.

17 Claims, 6 Drawing Sheets

PACKAGING MACHINES AND IMPROVEMENTS THERETO

FIELD OF THE DISCLOSURE

The present invention relates generally to a machine for automatically placing a packaging article, such as a sleeve or carton, around a pack.

BACKGROUND OF THE DISCLOSURE

There are many circumstances in which a final product is placed in a sleeve; for example food packs such as trays, cartons and the like. Machines for automating the process of placing the product in the sleeve (or the sleeve around the product) are known.

DETAILED DESCRIPTION

Figure 1:
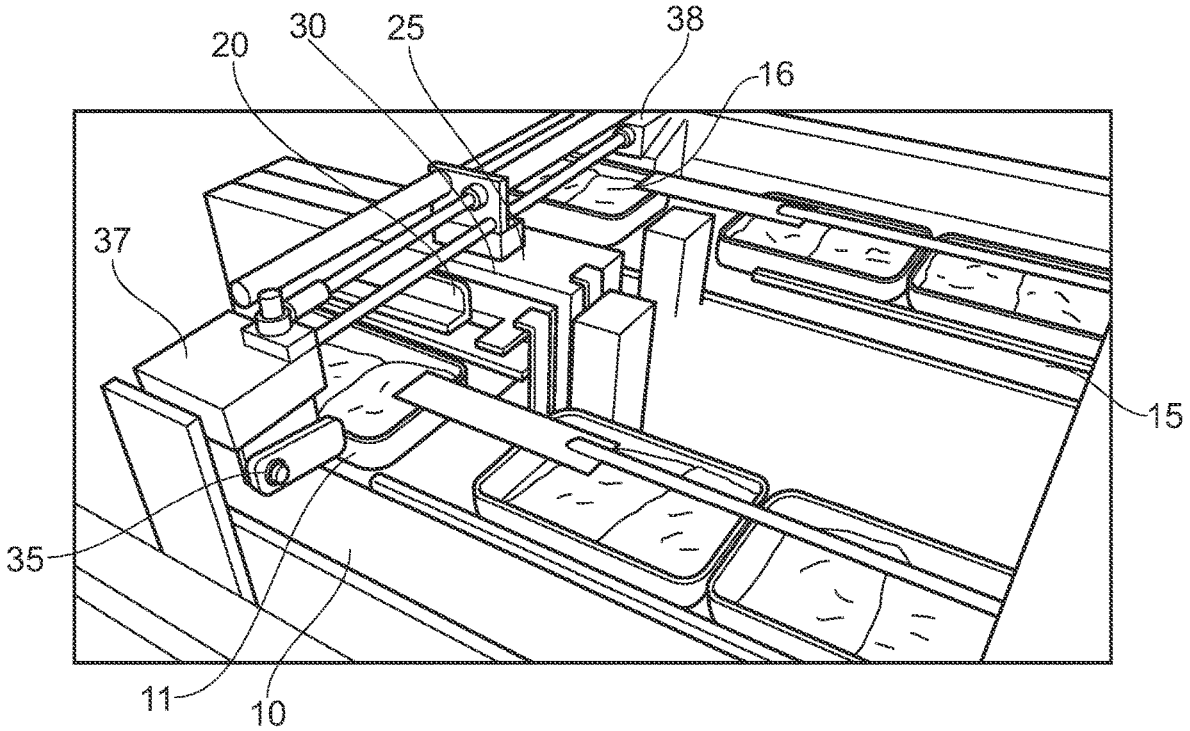
FIG. 1 shows one embodiment of an in-feed portion of a packaging machine according to the present disclosure.

An aspect of the present invention provides an automatic packaging machine comprising a plurality of in-feed conveyors for separately conveying contents, the conveyors being at different heights, and means for placing the contents into a packaging article, or placing the article around the contents, with the contents in a vertically stacked configuration.

The conveyors may be laterally offset from each other and the machine may comprises means for laterally converging the contents from the conveyors into a stacked configuration.

In some embodiments the present invention provides a sleeving machine with an in-feed tray stacking system, which may comprise lateral in-feed from opposite sides and different levels.

A spacer arrangement may be provided for maintaining a space between contents in the stacked configuration, for example as they are fed towards a packaging article.

In some embodiments the contents are pushed into an article.

The machine may further comprise means for automatically erecting a packaging article from a generally flat, folded configuration to an erected configuration. A plurality of such articles may be held in a hopper ready for use.

In some embodiments just two conveyors are provided, giving an upper and lower feed.

The packaging article may comprise a (pre-glued) sleeve, carton or the like.

In embodiments where the article is a sleeve, the sleeve may comprise one or more dividers defining apertures for receiving contents. This can be used, for example, as a guide to help keep trays separate as they are simultaneously inserted.

In some embodiments the contents may comprise trays. The trays may, for example, themselves hold different contents, for example different ingredients of a food product.

The present invention also provides an automatic sleeving machine comprising first and second in-feed conveyors which convey trays, the conveyors being at different heights and being laterally offset, and comprising means for laterally converging the trays to a vertically stacked configuration, the machine comprising means for erecting a sleeve ready to receive trays, and the machine further comprising means for moving the trays into the sleeve in the stacked configuration.

In some embodiments the machine is formed as a double decker carton stacker with lateral in-feed from opposite sides.

The present invention also provides a method of inserting trays into packaging sleeves comprising the steps of: in-feeding trays on separate conveyors which are at different heights and laterally offset; converging trays to a vertical stack; and inserting the trays into a packaging sleeve in the vertical stack.

Some aspects and embodiments of the invention are configured for use with a 4, 5 or 6 panel packaging sleeve. In some embodiments the sleeves are generally flat or planar.

The present invention also provides a packaging sleeve consisting of four external panels and being foldable from a generally flat configuration to an erected configuration with a generally quadrilateral section, the sleeve comprising one or more internal divider panels defining internal apertures for receiving contents.

The divider panel/s may extend beyond either or both the ends of the external panels.

In some embodiments one divider panel is provided to define two apertures.

The apertures defined by divider panels may be generally the same size as each other.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combinations other than those explicitly set out in the claims.

The present invention will now be more particularly described, by way of example, with reference to the accompanying drawings.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

In the following description, all orientational terms, such as upper, lower, radially and axially, are used in relation to the drawings and should not be interpreted as limiting on the invention.

FIG. 1 shows an in-feed portion of a packaging machine. The machine comprises a first belt conveyor 10 and a second belt conveyor 15. The conveyors 10, 15 are at different heights; in this embodiment the conveyor 10 is a lower conveyor and the conveyor 15 is an upper conveyor. In addition the conveyors 10, 15 are laterally offset; in this embodiment the conveyor 10 is a left-side conveyor and the conveyor 15 is a right-side conveyor.

Each of the conveyors 10, 15 transports trays 11, 16. When a tray 11, 16 reaches the end of each conveyor 10, 15 they are in the position shown in FIG. 1, with the tray 16 higher than the tray 11.

The machine has a spacer arrangement in the form of a pair of elongate spacer plates 20, 25 which are themselves longitudinally spaced by a central gap 30. The machine also has a pair of pushers 35, 36 carried on overhead carriages 37, 38.

Figure 2:
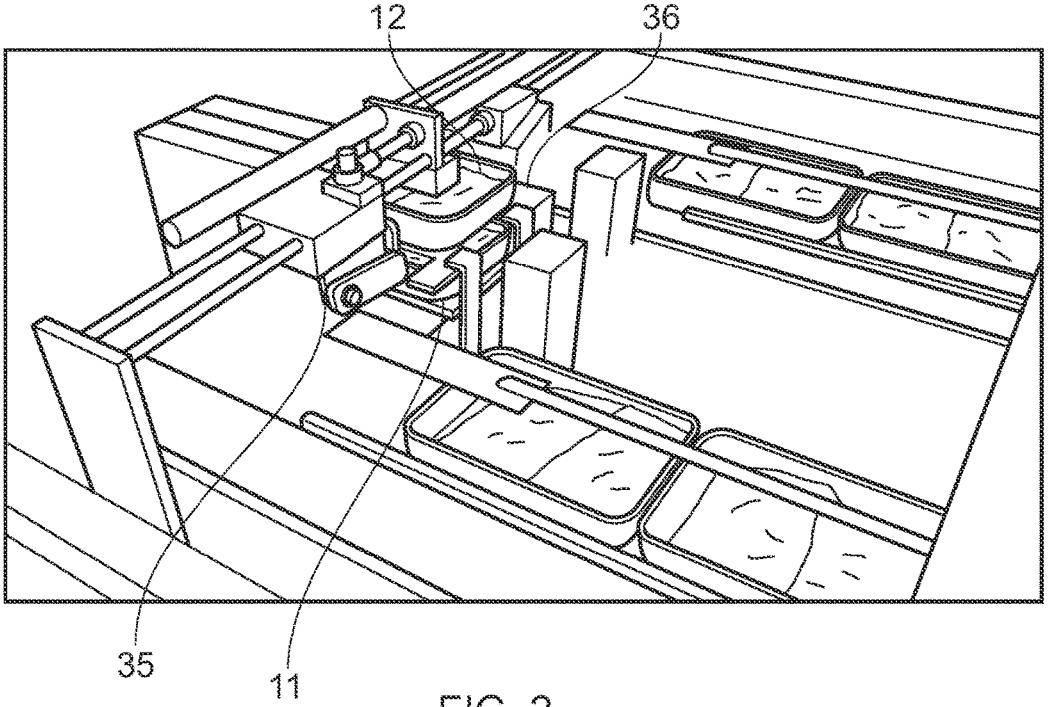
FIG. 2 shows the embodiment of the in-feed portion of FIG. 1, illustrating the operation of the device.

Referring now to FIG. 2, the trays 11, 16 are moved laterally inwards by the pushers 35, 36 until they sit directly one above the other as shown in the figure. It will be noted that the tray 11 slides under the spacer arrangement and the tray 16 slides over the spacer arrangement so they are spaced.

Figure 3:
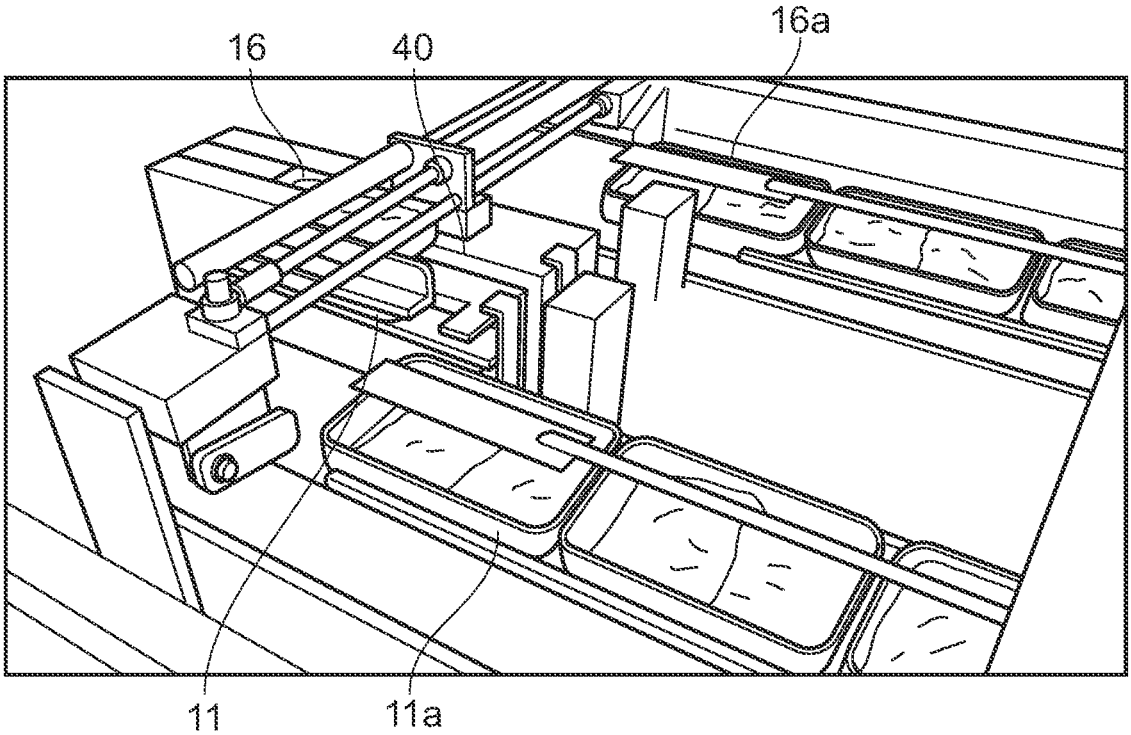
FIG. 3 shows the embodiment of the in-feed portion of FIG. 1, further illustrating the operation of the device.
Figure 4:
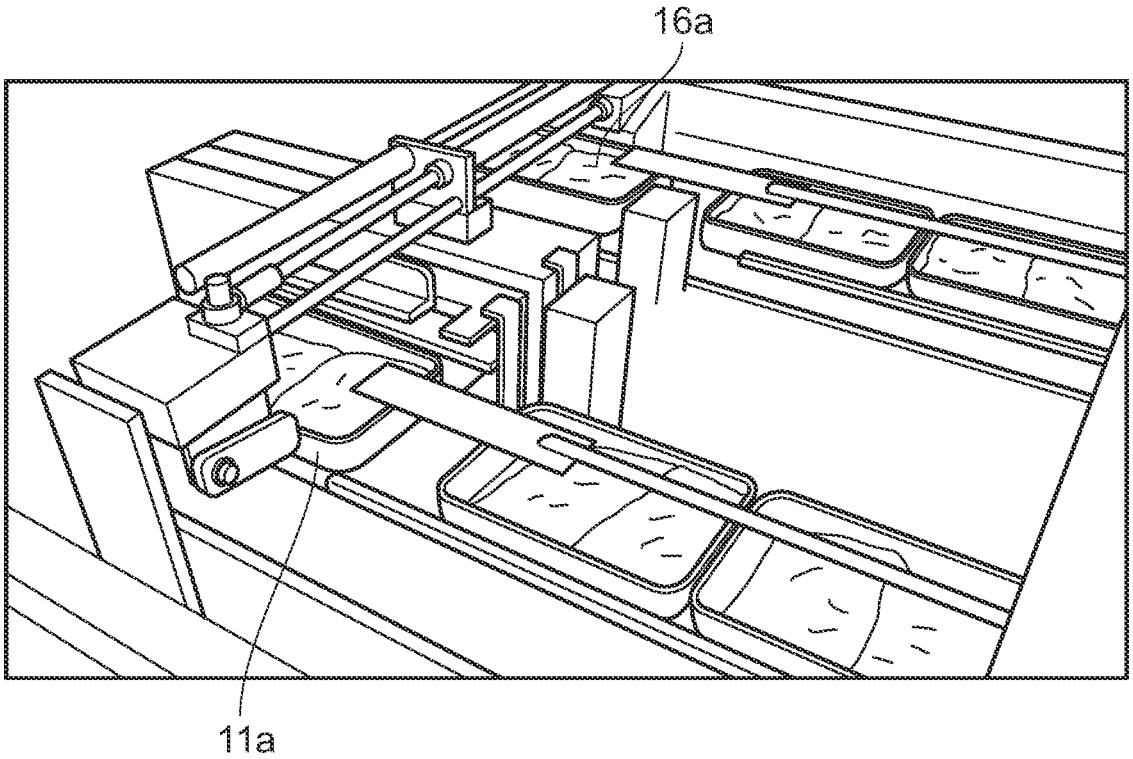
FIG. 4 shows the embodiment of the in-feed portion of FIG. 1, further illustrating the operation of the device.

Referring now to FIG. 3, the trays 11, 16, in the vertically stacked configuration, are moved off together along the spacer plates 20, 25 by a chain-driven lug 40. In addition, as the trays 11, 16 move off the next pair of trays 11*a*, 16*a* move into position at the end of the conveyors ready to converge (FIG. 4).

Figure 5:
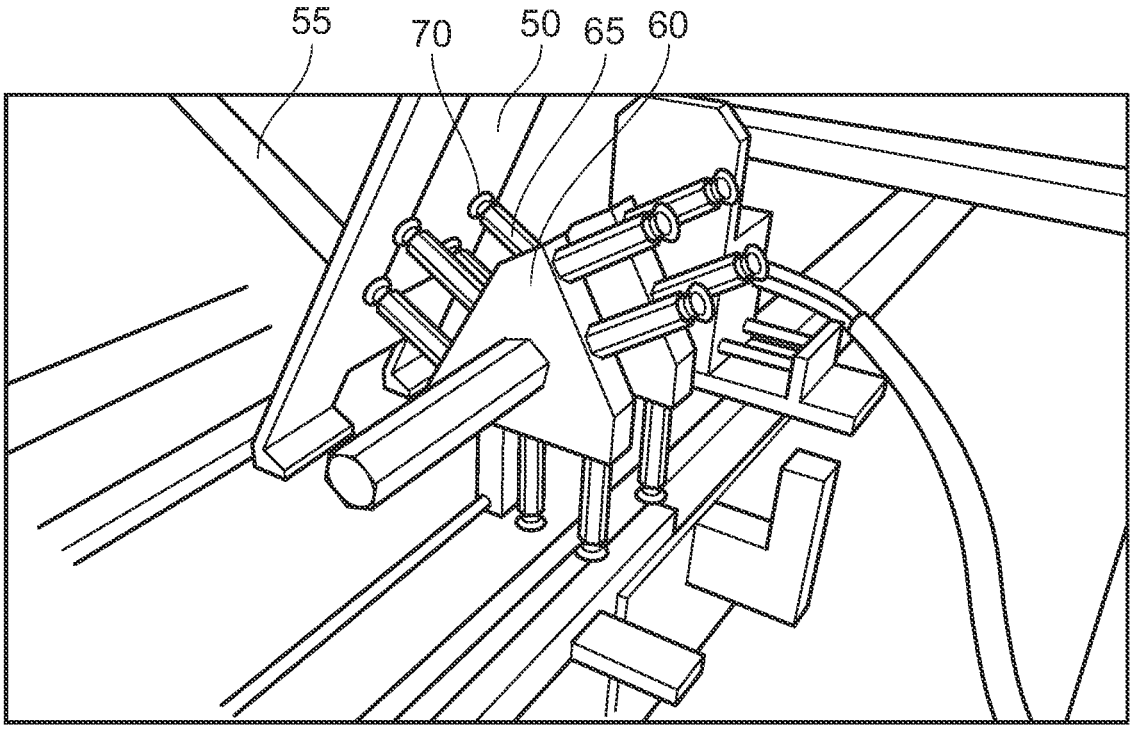
FIG. 5 shows one embodiment of a sleeving station of a packaging machine according to the present disclosure.

Downstream of the in-feed and convergence/combination portions of the machine a sleeving station is provided (FIG. 5).

A stack of sleeves 50 is held in a hopper 55. An indexing rotor 60 has three sets of four suction rods 65 each carrying a suction cup 70. In a first position a set of suction rods picks the first sleeve in the stack (FIG. 5).

Figure 6:
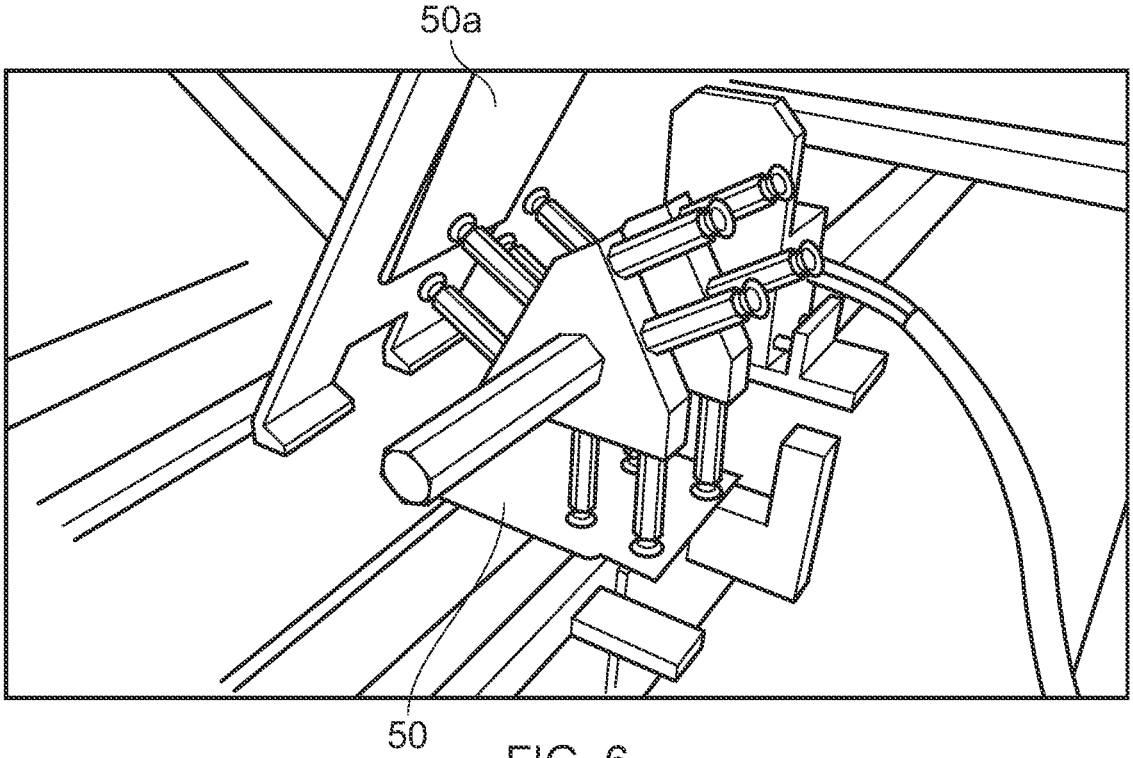
FIG. 6 shows the embodiment of the sleeving station of FIG. 5, illustrating the operation of the device.

The rotor 60 then indexing around to the position shown in FIG. 6, with the first sleeve 50 horizontal (but still flat). The next set of rods contacts the next sleeve 50*a* in the stack.

Figure 7:
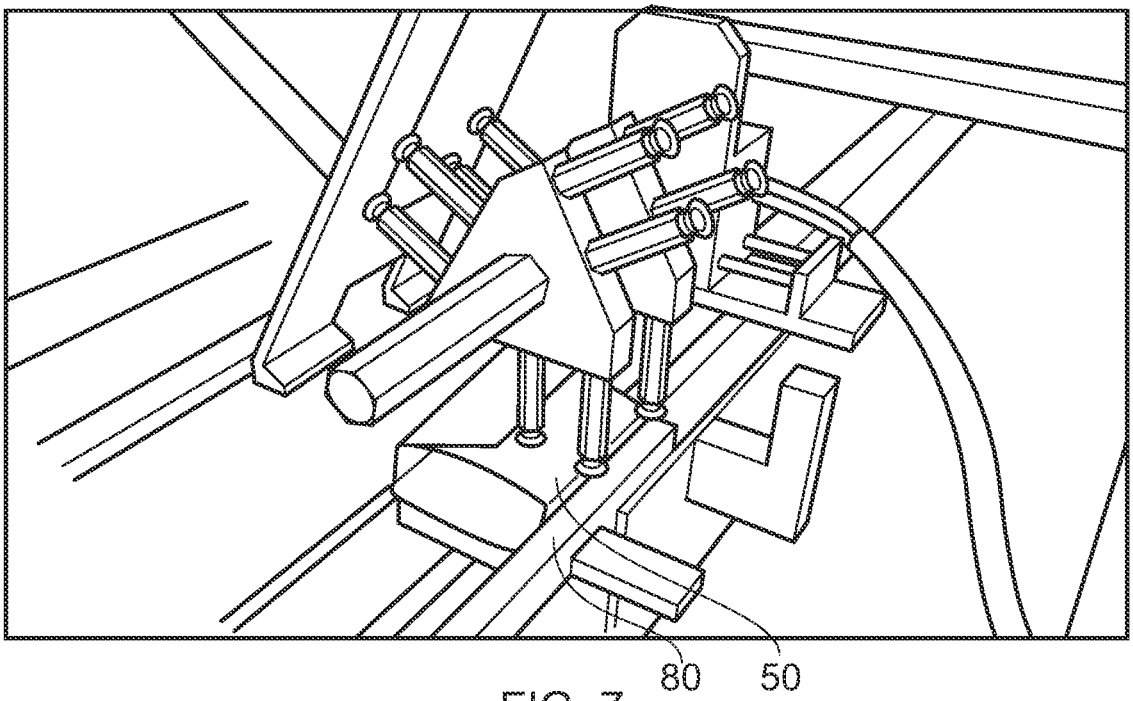
FIG. 7 shows the embodiment of the sleeving station of FIG. 5, further illustrating the operation of the device.
Figure 8:
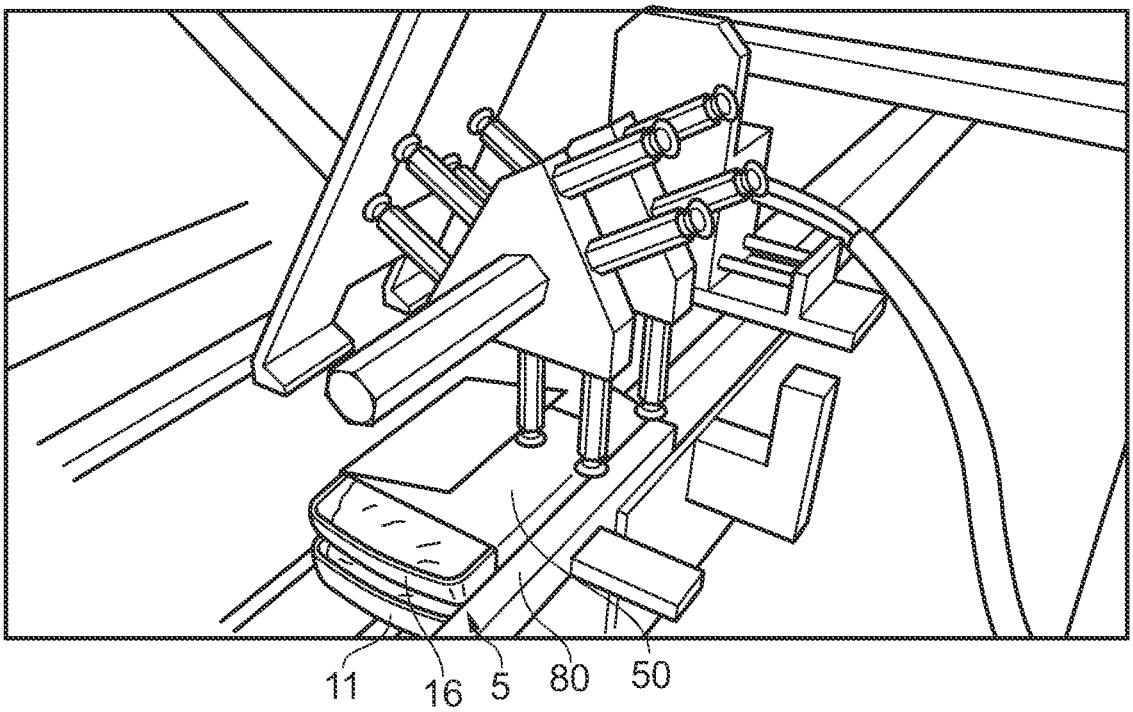
FIG. 8 shows the embodiment of the sleeving station of FIG. 5, further illustrating the operation of the device.

As the rotor indexes around again the sleeve 50 is pulled over a curved guide surface 80 and caused to open (FIG. 7). The sleeve (an example of which is described in more detail below) has two bays or apertures for receiving the upper and lower trays 11, 16, which are pushed into the sleeve by the lug 40 (FIG. 8). The completed "double decker" pack 5 then moves off and the next sleeve is moved into position.

Figure 9:
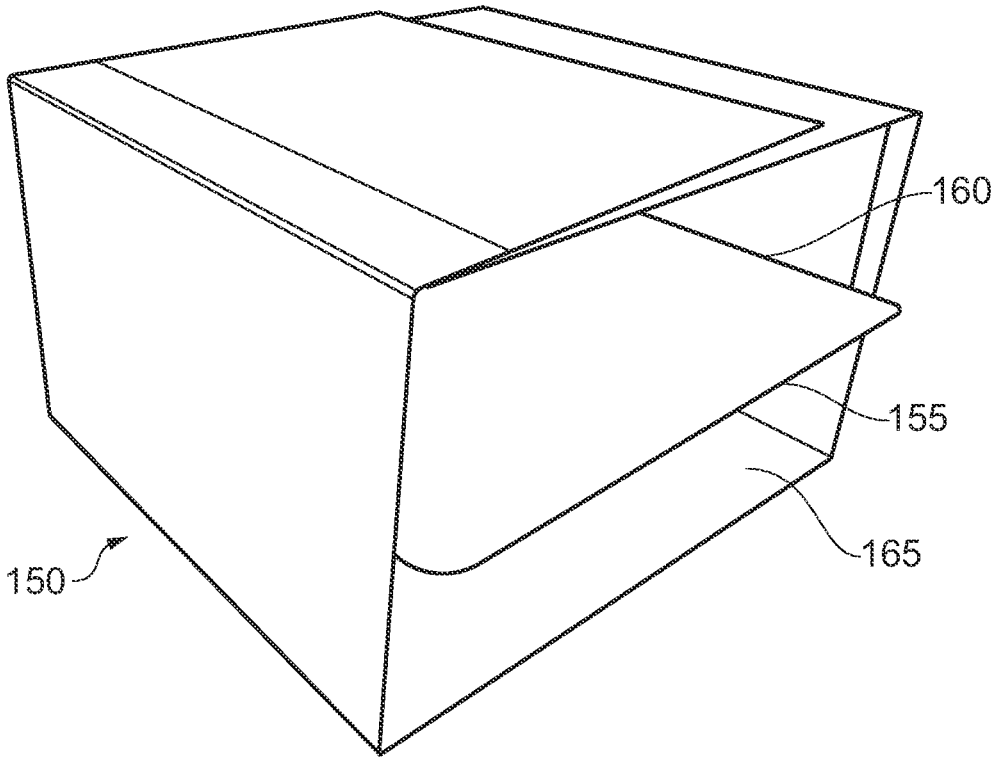
FIG. 9 shows a first view of one embodiment of a packaging sleeve formed in accordance with the present disclosure in an erect position.
Figure 10:
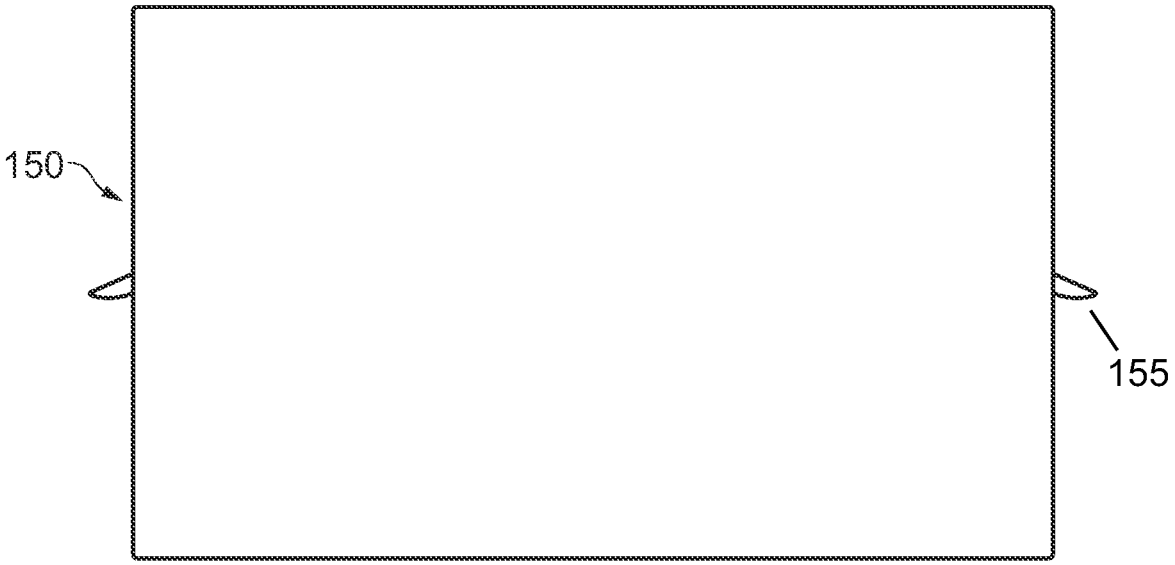
FIG. 10 shows a second view of the packaging sleeve of FIG. 9.
Figure 11:
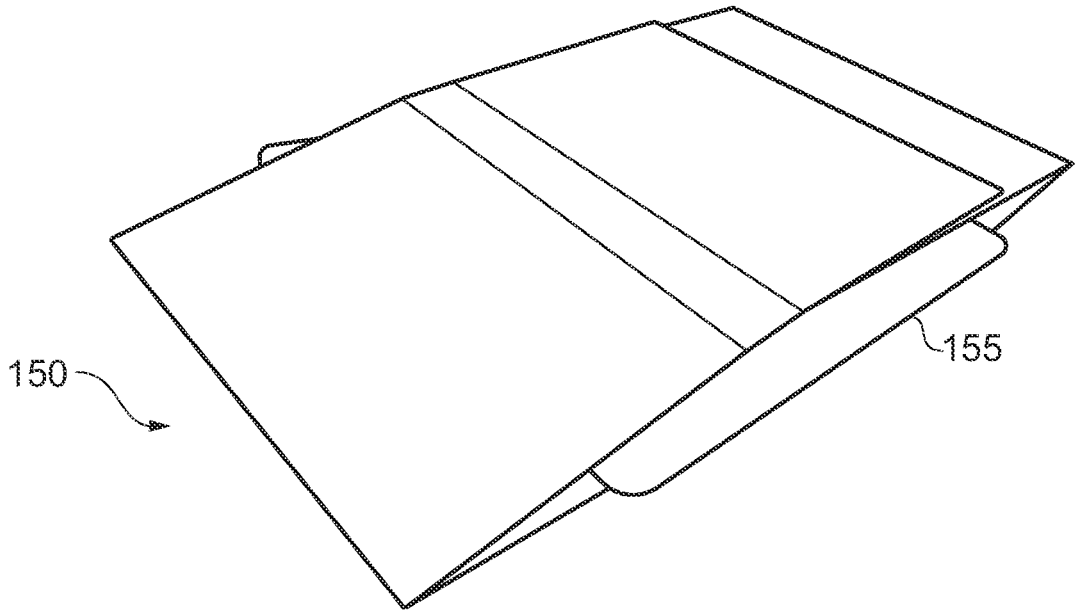
FIG. 11 shows the packaging sleeve of FIGS. 9 and 10 in a flat position.
Figure 12:
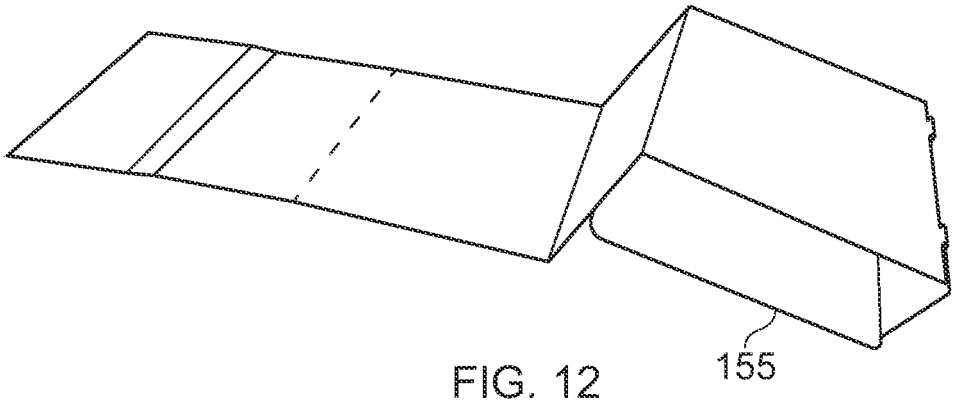
FIG. 12 shows the packaging sleeve of FIGS. 9 and 10 in a partially assembled form.
Figure 13:
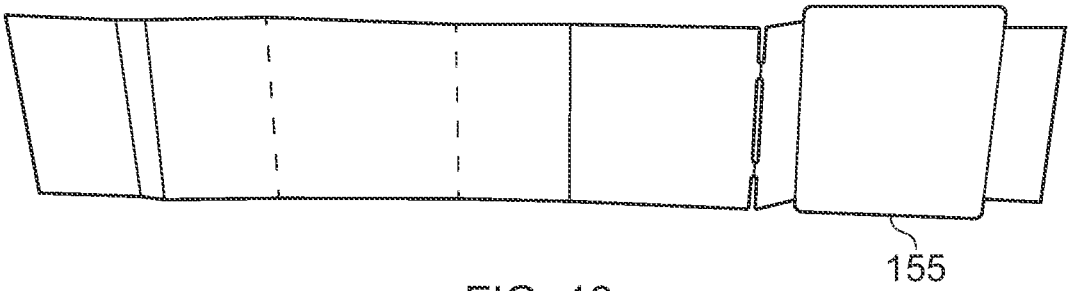
FIG. 13 shows the packaging sleeve of FIGS. 9 and 10 in a fully unassembled form.

Referring now to FIGS. 9 and 10 there is shown a packaging sleeve 150 formed in accordance with the present invention and shown in an erected position; FIG. 11 shows the sleeve in a flat position. FIG. 12 shows the sleeve partially assembled and FIG. 13 shows the sleeve fully unassembled (before folding and gluing).

The sleeve 150 has a generally rectangular section, with a four-panel external structure and an internal divider panel 155 defining upper 160 and lower 165 apertures for receiving contents, such as trays. As best shown in FIG. 10, the divider panel 155 extended beyond the other panels. These "flaps" help to guide trays into the apertures 160, 165 as they are inserted, for example simultaneously, in use.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

What is claimed:

1. An automatic packaging machine comprising:

a plurality of in-feed conveyors for separately conveying contents, the plurality of in-feed conveyors being at different heights, in a vertical direction, and being laterally offset from each other, in a lateral direction that is perpendicular to the vertical direction; and means for placing the contents into a packaging article with the contents in a vertically stacked configuration;

wherein the means for placing the contents into the packaging article with the contents in the vertically stacked configuration comprises:

at least one lateral pusher for laterally converging the contents, in the lateral direction, from the plurality of in-feed conveyors into the vertically stacked configuration, and a longitudinal pusher for simultaneously inserting the contents in the vertically stacked configuration into the packaging article, in a longitudinal direction that is perpendicular to the vertical direction and perpendicular to the lateral direction, and wherein:

the packaging article comprises a sleeve, the sleeve comprising one or more divider panels defining a plurality of apertures for receiving the contents from the vertically stacked configuration; and a spacer for maintaining a space between the contents in the vertically stacked configuration, in the vertical direction, the spacer comprising a pair of spacer plates that are spaced apart laterally, in the lateral direction, by a central gap that extends longitudinally, in the longitudinal direction.

2. The automatic packaging machine of claim 1, further comprising means for automatically erecting the sleeve from a flat, folded configuration to an erected configuration.

3. The automatic packaging machine of claim 1, wherein the plurality of in-feed conveyors comprises two in-feed conveyors.

4. The automatic packaging machine of claim 1, wherein the contents comprise trays.

5. The automatic packaging machine of claim 2, wherein the sleeve consists of four external panels and is foldable from the flat, folded configuration to the erected configuration, and wherein the sleeve has a quadrilateral section in the erected configuration.

6. The automatic packaging machine of claim 5, wherein each divider panel extends beyond either or both ends of the external panels.

7. The automatic packaging machine of claim 1, wherein the one or more divider panels comprises one internal divider panel that defines two apertures.

8. The automatic packaging machine of claim 1, wherein the apertures are of the same size.

9. The automatic packaging machine of claim 1, wherein the longitudinal pusher for simultaneously inserting the contents into the packaging article comprises a lug.

10. A method of inserting trays into a packaging sleeve, the method comprising the steps of:

a. in-feeding the trays on a plurality of separate in-feed conveyors, the plurality of in-feed conveyors being at different heights, in a vertical direction, and being laterally offset, in a lateral direction that is perpendicular to the vertical direction;

b. using lateral pushers, converging the trays from the plurality of separate in-feed conveyors into a vertically stacked configuration, wherein a space is present between the trays in the vertically stacked configuration, in the vertical direction, and the space is created by a spacer comprising a pair of spacer plates that are spaced apart laterally, in the lateral direction, by a central gap that extends longitudinally, in a longitudinal direction that is perpendicular to the vertical direction and perpendicular to the lateral direction;

c. automatically erecting the packaging sleeve from a flat, folded configuration to an erected configuration, wherein the packaging sleeve comprises one or more divider panels defining a plurality of apertures for receiving the trays from the vertically stacked configuration; and d. using a longitudinal pusher, simultaneously inserting the trays in the vertically stacked configuration into the packaging sleeve, in the longitudinal direction, wherein the trays are inserted into the plurality of apertures defined by the one or more divider panels.

11. An automatic packaging machine comprising:

a plurality of in-feed conveyors for separately conveying contents, the plurality of in-feed conveyors being at different heights, in a vertical direction, and being laterally offset from each other in a lateral direction that is perpendicular to the vertical direction, and a means for placing the contents into a packaging article with the contents in a vertically stacked configuration;

wherein the means for placing the contents into the packaging article with the contents in the vertically stacked configuration comprises:

at least one lateral pusher for laterally converging, in the lateral direction, the contents from the plurality of in-feed conveyors into the vertically stacked configuration, and a longitudinal pusher for simultaneously inserting the contents in the vertically stacked configuration into the packaging article in a longitudinal direction that is perpendicular to the vertical direction and perpendicular to the lateral direction; and wherein:

a spacer is provided for maintaining a space between the contents in the vertically stacked configuration, in the vertical direction, the spacer comprising a pair of elongate spacer plates that are spaced apart laterally, in the lateral direction, by a central gap that extends longitudinally, in the longitudinal direction;

the longitudinal pusher comprises a lug; and the lug travels in the central gap between the pair of elongate spacer plates, to push the contents in the vertically stacked configuration along the pair of elongate spacer plates.

12. The automatic packaging machine of claim 11, further comprising a means for automatically erecting the packaging article from a flat, folded configuration to an erected configuration.

13. The automatic packaging machine of claim 11, wherein the packaging article is a sleeve.

14. The automatic packaging machine of claim 13, wherein the sleeve comprises one or more divider panels defining a plurality of apertures for receiving the contents from the vertically stacked configuration.

15. The automatic packaging machine of claim 14, wherein the apertures are of the same size.

16. The automatic packaging machine of claim 11, wherein the contents are trays.

17. The automatic packaging machine of claim 11, wherein the lug is a chain-driven lug.

* * * * *